US009816193B2

(12) United States Patent
Ganesan et al.

(10) Patent No.: US 9,816,193 B2
(45) Date of Patent: Nov. 14, 2017

(54) CONFIGURATION AND METHOD OF OPERATION OF AN ELECTRODEPOSITION SYSTEM FOR IMPROVED PROCESS STABILITY AND PERFORMANCE

(75) Inventors: Kousik Ganesan, Tualatin, OR (US); Tighe Spurlin, Portland, OR (US); Jonathan D. Reid, Sherwood, OR (US); Shantinath Ghongadi, Tigard, OR (US); Andrew McKerrow, Lake Oswego, OR (US); James E. Duncan, Beaverton, OR (US)

(73) Assignee: Novellus Systems, Inc., Fremont, CA (US)

( * ) Notice: Subject to any disclaimer, the term of this patent is extended or adjusted under 35 U.S.C. 154(b) by 1288 days.

(21) Appl. No.: 13/324,890

(22) Filed: Dec. 13, 2011

(65) Prior Publication Data

US 2012/0175263 A1 Jul. 12, 2012

Related U.S. Application Data

(60) Provisional application No. 61/430,709, filed on Jan. 7, 2011.

(51) Int. Cl.
*C25D 7/12* (2006.01)
*C25D 21/04* (2006.01)
(Continued)

(52) U.S. Cl.
CPC ..... *C25D 3/38* (2013.01); *C25D 5/003* (2013.01); *C25D 5/08* (2013.01); *C25D 7/123* (2013.01);
(Continued)

(58) Field of Classification Search
CPC ..... C25D 21/04; C25D 7/123; C25D 5/003
(Continued)

(56) References Cited

U.S. PATENT DOCUMENTS 3,956,120 A 5/1976 Kardos et al.
4,555,135 A 11/1985 Freeland
(Continued)

FOREIGN PATENT DOCUMENTS

CN 1499992 A 5/2004
CN 1609281 A 4/2005
(Continued)

OTHER PUBLICATIONS

Lee, Wen-Hsi et al., "Bis-(3-sodiumsulfopropyl disulfide) Decomposition with Cathodic Current Flowing in a Copper-Electroplating Bath," J.Electrochem.Soc., vol. 157, No. 1 (2010), pp. H131-H135.
(Continued)

*Primary Examiner* — Bryan D. Ripa
(74) *Attorney, Agent, or Firm* — Weaver Austin Villeneuve & Sampson LLP

(57) ABSTRACT

Methods, systems, and apparatus for plating a metal onto a work piece with a plating solution having a low oxygen concentration are described. In one aspect, a method includes reducing an oxygen concentration of a plating solution. The plating solution includes about 100 parts per million or less of an accelerator. After reducing the oxygen concentration of the plating solution, a wafer substrate is contacted with the plating solution in a plating cell. The oxygen concentration of the plating solution in the plating cell is about 1 part per million or less. A metal is electroplated with the plating solution onto the wafer substrate in the plating cell. After electroplating the metal onto the wafer substrate, an oxidizing strength of the plating solution is increased.

16 Claims, 4 Drawing Sheets

(51) Int. Cl.

| | |
|---|---|
| ***C25D 3/38*** | (2006.01) |
| ***C25D 5/08*** | (2006.01) |
| ***C25D 17/00*** | (2006.01) |
| ***C25D 21/14*** | (2006.01) |
| ***C25D 5/00*** | (2006.01) |

(52) U.S. Cl.
CPC ..... *C25D 17/001* (2013.01); *C25D 21/04* (2013.01); *C25D 21/14* (2013.01)

(58) Field of Classification Search
USPC ..... 205/98
See application file for complete search history.

(56) References Cited

U.S. PATENT DOCUMENTS

| | | | | |
|---|---|---|---|---|
| 5,252,196 | A | 10/1993 | Sonnenberg et al. | |
| 6,113,769 | A * | 9/2000 | Uzoh et al. | 205/101 |
| 6,527,920 | B1 | 3/2003 | Mayer et al. | |
| 6,775,907 | B1 | 8/2004 | Boyko et al. | |
| 6,793,796 | B2 | 9/2004 | Reid et al. | |
| 6,821,407 | B1 | 11/2004 | Reid et al. | |
| 6,942,779 | B2 * | 9/2005 | Belongia | C25D 21/18 205/101 |
| 6,946,065 | B1 | 9/2005 | Mayer et al. | |
| 7,727,863 | B1 * | 6/2010 | Buckalew et al. | 438/473 |
| 7,776,741 | B2 | 8/2010 | Reid et al. | |
| 8,262,871 | B1 | 9/2012 | Mayer et al. | |
| 2002/0027080 | A1 * | 3/2002 | Yoshioka et al. | 205/123 |
| 2002/0112964 | A1 | 8/2002 | Gandikota et al. | |
| 2002/0130046 | A1 * | 9/2002 | Cheung | C25D 3/38 205/104 |
| 2003/0094376 | A1 | 5/2003 | Seita et al. | |
| 2004/0000484 | A1 * | 1/2004 | Sun | G01N 31/164 205/81 |
| 2004/0060436 | A1 * | 4/2004 | Parekh et al. | 95/46 |
| 2004/0222100 | A1 * | 11/2004 | Basol | 205/99 |
| 2005/0164498 | A1 | 7/2005 | Ide et al. | |
| 2005/0205429 | A1 | 9/2005 | Gebhart et al. | |
| 2006/0012044 | A1 | 1/2006 | Knop et al. | |
| 2006/0046481 | A1 | 3/2006 | Tokuda | |
| 2006/0084267 | A1 | 4/2006 | Kwak et al. | |
| 2006/0134902 | A1 * | 6/2006 | Dubin et al. | 438/613 |
| 2006/0151328 | A1 * | 7/2006 | Reents et al. | 205/103 |
| 2007/0125657 | A1 * | 6/2007 | Sun et al. | 205/205 |
| 2008/0090414 | A1 | 4/2008 | Chen et al. | |
| 2009/0038952 | A1 * | 2/2009 | Tachibana et al. | 205/296 |
| 2009/0229986 | A1 | 9/2009 | Omura et al. | |
| 2010/0041226 | A1 * | 2/2010 | Reid et al. | 438/614 |
| 2010/0089758 | A1 | 4/2010 | Tomonaga et al. | |
| 2010/0300888 | A1 | 12/2010 | Ponnuswamy et al. | |
| 2010/0320081 | A1 | 12/2010 | Mayer et al. | |
| 2010/0320609 | A1 | 12/2010 | Mayer et al. | |
| 2011/0056840 | A1 * | 3/2011 | Isono et al. | 205/296 |
| 2011/0226614 | A1 | 9/2011 | Rash et al. | |
| 2011/0297551 | A1 * | 12/2011 | Morita et al. | 205/186 |
| 2012/0064462 | A1 | 3/2012 | Willey et al. | |
| 2013/0284604 | A1 | 10/2013 | Spurlin et al. | |

FOREIGN PATENT DOCUMENTS

| | | | |
|---|---|---|---|
| CN | 1749442 | A | 3/2006 |
| CN | 101407935 | A | 4/2009 |
| CN | 101517131 | A | 8/2009 |
| JP | 2004143478 | A | 5/2004 |
| JP | 2006-111976 | A | 4/2006 |
| JP | 2006111976 | A | 4/2006 |
| JP | 2007169700 | A | 7/2007 |
| JP | 2009-149979 | A | 7/2009 |
| TW | I255871 | B | 6/2006 |
| TW | 200636887 | A | 10/2006 |
| TW | I281516 | B | 5/2007 |
| WO | WO 02/062446 | | 8/2002 |

OTHER PUBLICATIONS

Wang, Wei et al., "Invalidating mechanism of bis (3-sulfopropyl) disulfide (SPS) during copper via-filling process," Applied Surface Science, vol. 255, No. 8, Feb. 1, 2009, pp. 4389-4392.
Reid, J.D., "An HPLC Study of Acid Copper Brightener Properties", Printed Circuit Fabrication (Nov. 1987), pp. 65-75.
U.S. Office Action dated Dec. 6, 2013 issued in U.S. Appl. No. 13/229,615.
U.S. Final Office Action dated Mar. 27, 2014 issued in U.S. Appl. No. 13/229,615.
Chinese First Office Action dated Mar. 19, 2015 issued in CN 201110281341.7.
Chinese First Office Action dated Jun. 17, 2015 issued in CN 201210005429.0.
Lee, Wen-Hsi et al. (2010) "Bis-(3-sodiumsulfopropyl disulfide) Decomposition with Cathodic Current Flowing in a Copper-Electroplating Bath," *J.Electrochem.Soc.*,157(1):H131-H135.
Reid, J.D. (1987) "An HPLC Study of Acid Copper Brightener Properties", *Printed Circuit Fabrication*, pp. 65-75.
Wang, Wei et al. (2009) "Invalidating mechanism of bis (3-sulfopropyl) disulfide (SPS) during copper via-filling process," *Applied Surface Science*, 255(8):4389-4392.
U.S. Office Action dated Nov. 17, 2015 issued in U.S. Appl. No. 13/869,891.
Taiwanese Office Action dated Aug. 6, 2015 issued in TW 100149613.
Frank and Bard, (2003) "The Decomposition of the Sulfonate Additive Sulfopropyl Sulfonate in Acid Copper Electroplating Chemistries," J. of the Electrochem. Society, 150(4): C244-C250.
Zhou, Haixian (Jan. 31, 2010) "Micro-Opto-Electro-Mechanical Systems," National Defense Industry Press, 5pp.
U.S. Final Office Action dated Apr. 28, 2016 issued in U.S. Appl. No. 13/869,891.
U.S. Office Action dated Jan. 6, 2017 issued in U.S. Appl. No. 13/869,891.
Taiwanese Office Action dated Jun. 1, 2016 issued in TW 100149613.
Taiwanese Office Action dated Aug. 11, 2016 issued in TW 102115253.
U.S. Notice of Allowance dated Jul. 12, 2017 issued in U.S. Appl. No. 13/869,891.

* cited by examiner

CONFIGURATION AND METHOD OF OPERATION OF AN ELECTRODEPOSITION SYSTEM FOR IMPROVED PROCESS STABILITY AND PERFORMANCE

CROSS-REFERENCE TO RELATED APPLICATIONS

This application claims benefit under 35 U.S.C. §119(e) to U.S. Provisional Patent Application No. 61/430,709, filed Jan. 7, 2011, which is herein incorporated by reference.

BACKGROUND

Damascene processing is a method for forming metal lines on integrated circuits. It is often used because it requires fewer processing steps than other methods and offers a high yield. Conductive routes on the surface of an integrated circuit formed during Damascene processing are commonly filled with copper. The copper may be deposited in the conductive routes with an electroplating process using a plating solution.

SUMMARY

Methods, apparatus, and systems for plating metals are provided. According to various implementations, the methods involve reducing the oxygen concentration in a plating solution, contacting a wafer substrate with the plating solution, electroplating a metal onto the wafer substrate, and increasing the oxidizing strength of the plating solution.

According to one implementation, a method of electroplating a metal onto a wafer substrate includes reducing an oxygen concentration of a plating solution, with the plating solution including about 100 parts per million or less of an accelerator. After reducing the oxygen concentration of the plating solution, a wafer substrate is contacted with the plating solution in a plating cell. The oxygen concentration of the plating solution in the plating cell is about 1 part per million or less. A metal is electroplated with the plating solution onto the wafer substrate in the plating cell. After plating, an oxidizing strength of the plating solution is increased.

According to one implementation, an apparatus for electroplating a metal includes a plating cell, a degassing device, an oxidation station, and a controller. The plating cell is configured to hold a plating solution. The degassing device is coupled to the plating cell and is configured to remove oxygen from the plating solution prior to the plating solution flowing into the plating cell. The oxidation station is coupled to the plating cell, and the oxidation station is configured to increase an oxidizing strength of the plating solution after the plating solution flows out of the plating cell. The controller includes program instructions for conducting a process including the operations of reducing an oxygen concentration of the plating solution using the degassing device. The plating solution includes about 100 parts per million or less of an accelerator. After the degassing, a wafer substrate is contacted with the plating solution in the plating cell. The oxygen concentration of the plating solution in the plating cell is about 1 part per million or less. A metal is electroplated with the plating solution onto the wafer substrate in the plating cell. After the electroplating, the oxidizing strength of the plating solution is increased using the oxidation station.

According to one implementation, a non-transitory computer machine-readable medium comprising program instructions for control of a deposition apparatus includes code for reducing an oxygen concentration of a plating solution. The plating solution may include about 100 parts per million or less of an accelerator. After reducing the oxygen concentration of the plating solution, a wafer substrate is contacted with the plating solution in a plating cell. The oxygen concentration of the plating solution in the plating cell is about 1 part per million or less. A metal is electroplated with the plating solution onto the wafer substrate in the plating cell. After plating, an oxidizing strength of the plating solution is increased.

These and other aspects of implementations of the subject matter described in this specification are set forth in the accompanying drawings and the description below.

DETAILED DESCRIPTION

Figure 1:
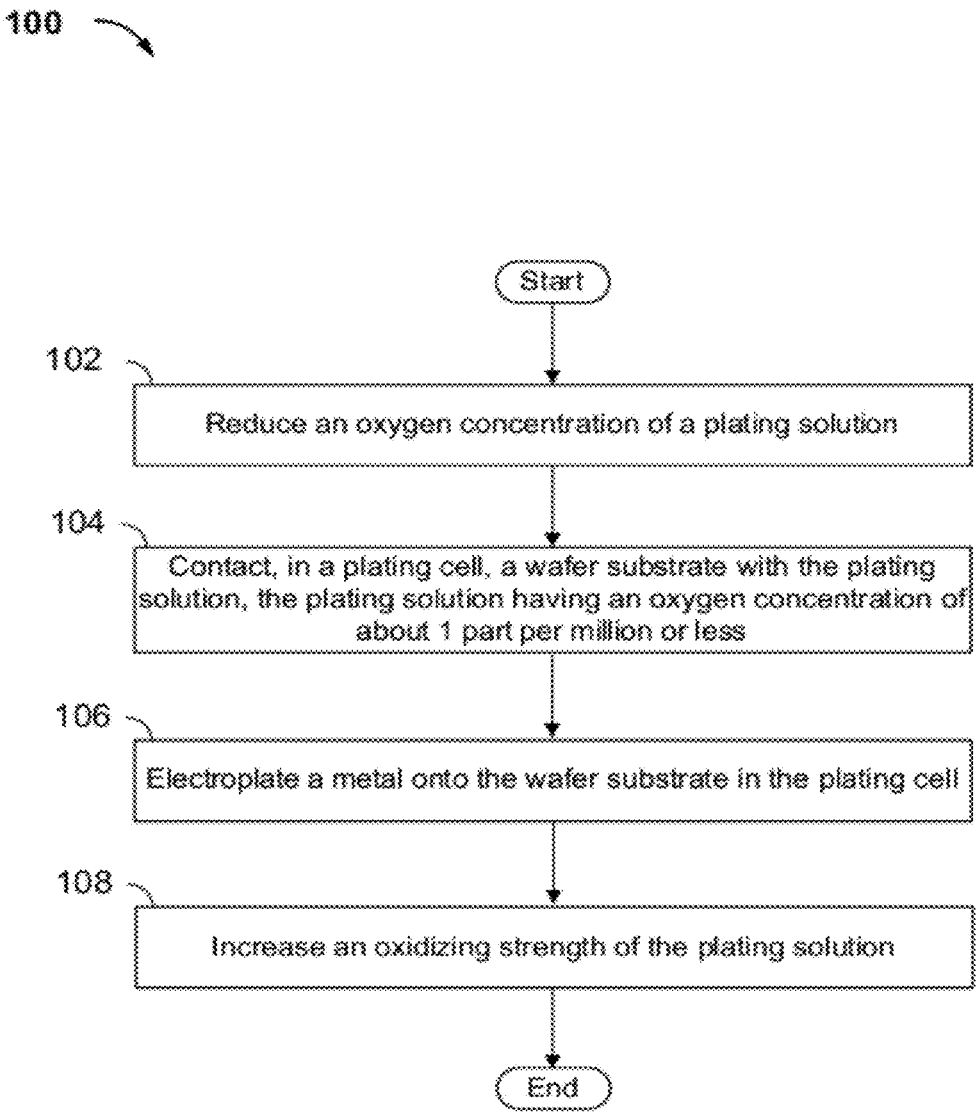
FIG. 1 shows an example of a method of electroplating a metal onto a wafer substrate.

Generally, the implementations described herein provide apparatus and methods for controlling plating solution composition.

In the following detailed description, numerous specific implementations are set forth in order to provide a thorough understanding of the disclosed implementations. However, as will be apparent to those of ordinary skill in the art, the disclosed implementations may be practiced without these specific details or by using alternate elements or processes. In other instances well-known processes, procedures, and components have not been described in detail so as not to unnecessarily obscure aspects of the disclosed implementations.

In this application, the terms "semiconductor wafer," "wafer," "substrate," "wafer substrate," and "partially fabricated integrated circuit" are used interchangeably. One of ordinary skill in the art would understand that the term "partially fabricated integrated circuit" can refer to a silicon wafer during any of many stages of integrated circuit fabrication thereon. The following detailed description assumes the disclosed implementations are implemented on a wafer substrate. However, the disclosed implementations are not so limited. The work piece may be of various shapes, sizes, and materials. In addition to semiconductor wafers, other work pieces that may take advantage of the disclosed implementations include various articles such as printed circuit boards and the like.

Various aspects of the implementations disclosed herein pertain to methods of controlling the gas concentration in and the oxidizing strength of a plating solution. This may be accomplished by separate mechanisms employed at distinct positions in a plating solution flow path in a plating apparatus. For example, an implementation of a method may include (a) degassing a plating solution prior to introducing it to a plating cell, and (b) increasing the oxidizing strength of the plating solution at a location downstream from the plating cell. The oxidizing strength of the plating solution may be increased to a level that promotes or maintains formation of plating additives in a desirable oxidation state (e.g., a disulfide form of an accelerator).

Degassing the plating solution which contacts a wafer substrate to plate a metal onto the wafer substrate may reduce the corrosion of the seed layer on the wafer substrate and aid in dissolving small air bubbles on the wafer substrate. In addition, degassing of the plating solution may disrupt the oxidative breakdown of additives in the plating solution, particularly the accelerator, thereby reducing additive use and reducing of the formation of detrimental byproducts of the additives, allowing for longer plating solution life. This is especially true when degassing the plating solution is combined with a plating cell having a separated anode chamber such that the oxidation of additives on the anode is also prevented. Electroplating apparatuses having separate anode chambers are described in U.S. Pat. Nos. 6,527,920 and 6,821,407, both of which are herein incorporated by reference.

If the plating solution is maintained at about 0.1 parts per million (ppm) to 1 ppm oxygen concentration, however, then the normal oxidation of an accelerator, which is reduced at the wafer substrate during plating, is prevented as described below. This quickly results in depolarization of the plating solution and a loss of filling ability of the plating solution. To overcome this problem, and in accordance with various implementations described herein, the oxidizing strength of the plating solution may be increased after plating metal onto the wafer substrate.

Introduction

Plating solutions may contain a number of additives, including accelerators, suppressors, and levelers. Accelerators, alternatively termed brighteners, are additives which increase the rate of the plating reaction. Accelerators are molecules which adsorb on metal surfaces and increase the local current density at a given applied voltage. Accelerators may contain pendant sulfur atoms, which are understood to participate in the cupric ion reduction reaction and thus strongly influence the nucleation and surface growth of metal films. Accelerator additives are commonly derivatives of mercaptopropanesulfonic acid (MPS), dimercaptopropanesulfonic acid (DPS), or bis(3-sulfopropyl)disulfide (SPS), although other compounds can be used. Non-limiting examples of deposition accelerators include the following: 2-mercaptoethane-sulfonic acid (MESA), 3-mercapto-2-propane sulfonic acid (MPSA), dimercaptopropionylsulfonic acid (DMPSA), dimercaptoethane sulfonic acid (DMESA), 3-mercaptopropionic acid, mercaptopyruvate, 3-mercapto-2-butanol, and 1-thioglycerol. Some useful accelerators are described, for example, in U.S. Pat. No. 5,252,196, which is herein incorporated by reference. Accelerators are available commercially as Ultrafill A-2001 from Shipley (Marlborough, Mass.) or as SC Primary from Enthone Inc. (West Haven, Conn.), for example.

Suppressors, alternatively termed carriers, are polymers that tend to suppress current after they adsorb onto the metal surface. Suppressors may be derived from polyethylene glycol (PEG), polypropylene glycol (PPG), polyethylene oxide, or their derivatives or co-polymers. Commercial suppressors include Ultrafill S-2001 from Shipley (Marlborough, Mass.) and S200 from Enthone Inc. (West Haven, Conn.), for example.

Levelers generally are cationic surfactants and dyes which suppress current at locations where their mass transfer rate are most rapid. The presence of levelers, therefore, in a plating solution serve to reduce the film growth rate at protruding surfaces or corners where the levelers are preferentially absorbed. Absorption differences of levelers due to differential mass transfer effects may have a significant effect. Some useful levelers are described in, for example, in U.S. Pat. Nos. 5,252,196, 4,555,135 and 3,956,120, each of which is incorporated herein by reference. Levelers are available commercially as Liberty or Ultrafill Leveler from Shipley (Marlborough, Mass.) and Booster 3 from Enthone Inc. (West Haven, Conn.), for example. Accelerators, suppressors, and levels are further described in U.S. Pat. No. 6,793,796, which is herein incorporated by reference.

Conventional copper electroplating on a wafer substrate may, for example, be carried out using plating solutions which are in equilibrium with air and thus may contain about 8 ppm to 10 ppm of dissolved oxygen and larger amounts of dissolved nitrogen. This may lead to at least three different issues. First, when these plating solutions are passed through high pressure pumps to deliver the plating solution to the wafer substrate, the pressure changes that the plating solution experiences can result in air bubbles condensing out of solution in a low pressure zone between the pump and the wafer substrate. Such air bubbles can result in electroplating defects by landing on and adhering to the wafer substrate surface or accumulating in or on plating cell elements located below the wafer substrate and altering the electric field profile and the resulting plated thickness distribution on the wafer substrate.

Second, a copper seed layer within small features on a wafer substrate is often very thin and nearly discontinuous in spots. Dissolution of the seed layer in a plating solution before nucleation begins can result in a lack of seed layer and subsequent voids in the plated metal which is intended to fill the features. Dissolution of the seed layer may occur because oxygen in a plating solution may oxidize copper at a rate of about 1 nanometer per minute.

Third, additives in the plating solution may react with oxygen to form byproducts which can degrade the plating solution performance or require more frequent plating solution replenishment or treatment. For example, accelerator additives used in copper plating solutions, including SPS, DPS, related mercapto-containing species, and the byproducts of these compounds are known to be sensitive to the oxygen concentration in the plating solution. See, for example, Reid, J. D., "An HPLC Study of Acid Copper Brightener Properties", Printed Circuit Fabrication, (November 1987), pp. 65-75, which is incorporated herein by reference. While the byproducts which form are not fully known, the SPS which is initially added to a plating solution may be converted to its monomer MPS at the wafer substrate in a reduction reaction. Oxygen in the plating solution or oxidation by contact with the anode may convert the MPS back to SPS. SPS and MPS may remain in equilibrium in the plating solution. Thus, in this respect, some oxygen in a plating solution may be useful. MPS, however, can also be further irreversibly oxidized at the anode or by air to species (i.e., forming oxidized mercaptopropanesulfonic acid (MPSO)), which are not as readily re-converted to SPS. When these species begin to form, the total use of accelerator additives may increase and the total volume of byproducts in the plating solution may increase. Because the byproducts often degrade the plating solution, treatment of the plating solution to remove byproducts or replenishment of the plating solution may be necessary. Both of these options are costly.

Degassing a copper plating solution may aid in overcoming some of the above-noted issues. For example, relating to the first issue, when gasses, including molecular oxygen and molecular nitrogen, are removed from the plating solution so that the plating solution is not saturated with air, small air bubbles will spontaneously and more rapidly dissolve in the plating solution. When a wafer substrate enters the plating solution, the plating solution may wet the copper surface and generally displaces air on the surface and in the features on the wafer substrate. However, since entry of the wafer substrate into the plating solution can result in the generation of air bubbles, which may adhere to the wafer surface and cause missing metal defect (pits) by preventing plating, the rapid dissolution of air bubbles in the plating solution can be beneficial. The rate of air dissolution in an unsaturated solution can be about $1.2\times10^{-6}$ grams per square centimeter per second ($g/cm^2$-sec), resulting in fast removal of small air bubbles (e.g., the removal of a 10 micrometer scale bubble in about 1 second). For example, an about 4 times (4×) reduction of pit-type defects on a copper seed surface was observed when using a plating solution that had been degassed versus a plating solution that had not been degassed.

Relating to the second issue, reducing the oxygen concentration in the plating solution by degassing the plating solution may lead to lower corrosion rates of a copper seed layer when a wafer substrate is first immersed in a plating solution. For example, an approximately 50% reduction in the copper seed layer corrosion rate was observed when the oxygen concentration in the plating solution was reduced from about 8 ppm to about 0.5 ppm.

Relating to the third issue, reducing the oxygen concentration in the plating solution was observed to reduce the use of additives and also reduce the formation of additive byproducts. For example, the stability of an accelerator in a plating solution was observed to improve by about a factor of 2 when the plating solution was degassed to remove oxygen and the anode was isolated from the plating solution so the accelerator did not contact the anode. This was due to the disruption of the irreversible degradation of MPS (e.g., when SPS is the accelerator) to byproducts being suppressed.

As noted above, however, reducing the oxygen concentration in the plating solution can disrupt the equilibrium of the accelerator and species constituting the accelerator. For example, for a plating solution containing SPS as an accelerator, degassing the plating solution disrupts the re-equilibration of MPS formed during plating to SPS, and the plating solution performance may deteriorate rapidly.

More generally, some organic disulfide type accelerators may remain in equilibrium with mercaptan compounds in a plating solution. If the plating solution becomes too reducing (as it may when it is deoxygenated), then the equilibrium favors formation of the less oxidized version of the accelerator (e.g., the mercaptan form). This provides undesirable plating conditions (e.g., the plating solution can become too polarizing).

Thus, to address the third issue, increasing the oxidizing strength of a plating solution (e.g., by the re-introduction of oxygen to a plating solution) prior to degassing and pumping the plating solution to the wafer substrate may allow for SPS-MPS re-equilibration and for stable plating solution polarization and filling. For example, the plating solution while in a plating cell may contain a very low concentration of gasses (e.g., at least below saturation concentration). Elsewhere in the plating system that includes the plating cell, the plating solution may have an oxidizing strength such that plating solution additives, such as accelerators, remain in a suitably active state. Increasing the oxidizing strength of the plating solution outside of the plating cell may shift the equilibrium towards a favored form of the accelerator.

In summary, a concentration of oxygen in the plating solution for seed corrosion prevention and accelerator degradation prevention may be as close to zero as possible. A concentration of all dissolved gases in the plating solution for air bubble dissolution also may be as close to zero as possible. Due to the MPS-SPS equilibrium and the differing acceleration properties of these two molecules, however, the concentration of oxygen in the plating solution for accelerator effect on fill performance behavior in the plating system may be about 1 ppm oxygen or greater. To address these conflicting goals, methods and apparatus may be designed such that the wafer substrate is subjected to low gas concentrations while the time average concentration of oxygen or other oxidizing species in the plating solution is higher than about 1 ppm. Thus, plating solution characteristics may be maintained that yield bottom-up fill in features on a wafer substrate while the stability of the plating solution is improved (i.e., accelerator degradation is prevented). For example, in some implementations, a degasser may be placed before the plating cell so that the plating solution in contact with the wafer substrate has an oxygen concentration in the range of about 0.1 ppm to 1 ppm, but the plating solution is allowed to re-equilibrate with air or an oxidizing species in a reservoir so that the desired MPS-SPS reconversion yields good fill performance. The methods and apparatus combine the plating solution conditions which avoid poor filling of features in a wafer substrate while providing a low gas and/or oxygen concentration plating solution to the plating cell.

Method

Copper electroplating may employ a plating solution including an electrolyte of a copper salt, such as copper sulfate ($CuSO_4$), an acid to increase the conductivity of the plating solution, and various plating solution additives. Plating solution additives are generally present in low concentrations (about 10 parts per billion (ppb) to 1000 ppm) and affect the surface electrodeposition reactions. Generally, additives include accelerators, suppressors, levelers, and halides (chloride ions and bromide ions, for example), each having a unique and beneficial role in creating a copper film with desired micro- and macro-characteristics.

In some implementations, the concentration of copper ions from the copper salt is about 20 grams per liter (g/L) to 60 g/L. In some implementations, the concentration of accelerator is about 5 ppm to 100 ppm and the concentration of a leveler is about 2 ppm to 30 ppm. In some implementations, the bath includes a suppressor in a concentration of about 50 ppm to 500 ppm. In some implementations, the plating solution may further include an acid and chloride ions. In some implementations, the concentration of the acid is about 5 g/L to 200 g/L and the concentration of the chloride ions is about 20 g/L to 80 mg/L. In some implementations, the acid is sulfuric acid. In some other implementations, the acid is methanesulfonic acid.

In some implementations, the plating solution may include copper sulfate, sulfuric acid, chloride ions, and organic additives. In these implementations, the plating solution includes copper ions at a concentration of about 0.5 g/L to 80 g/L, about 5 g/L to 60 g/L, or about 18 g/L to 55 g/L, and sulfuric acid at a concentration of about 0.1 g/L to 400 g/L. Low-acid plating solutions typically contain about 5 g/L to 10 g/L of sulfuric acid. Medium and high-acid plating solutions contain sulfuric acid at concentrations of about 50 g/L to 90 g/L and 150 g/L to 180 g/L, respectively. Chloride ions may be present in a concentration range of about 1 g/L to 100 mg/L.

In a specific implementation, the plating solution is a plating solution sold under the trademark DVF 200™ (Enthone Inc.), which is a copper methane sulfonate/methane sulfonic acid plating solution to which accelerators, suppressors, leveler additives, and 50 ppm chloride ions, are added.

FIG. 1 shows an example of a method of electroplating a metal onto a wafer substrate. Starting at block 102 of the method 100, the oxygen concentration in a plating solution is reduced. For example, the oxygen concentration in the plating solution may be reduced by degassing the plating solution. The oxygen concentration in the plating solution may be due to oxygen in the atmosphere, and may be about 8 ppm to 10 ppm, depending on atmospheric pressure. In some implementations, the plating solution is degassed immediately before entering a plating cell, and in some implementation, the plating solution is degassed while in a plating cell. For example, the plating solution may be degassed by flowing the plating solution through a degasser.

Another method of reducing the oxygen concentration in the plating solution includes sparging. Sparging is a technique which involves bubbling a chemically inert gas through a liquid to remove dissolved gases from the liquid. For example, the plating solution may be sparged with helium to displace oxygen and nitrogen or sparged with nitrogen to selectively displace oxygen. Reducing the oxygen concentration in the plating solution may also be performed by the use of membranes to saturate rather than withdraw gas from the solution, or by the operation of a process tool in near vacuum conditions combined with selective gas introduction. For a discussion of various degassing techniques, see U.S. patent application Ser. No. 12/684,792, filed Jan. 8, 2010, which is incorporated herein by reference.

At block 104, a wafer substrate is contacted with the plating solution in a plating cell. In some implementations, the oxygen concentration of the plating solution in the plating cell is about 1 ppm or less. For example, the oxygen concentration of the plating solution in the plating cell may be about 0.1 ppm to 1 ppm.

At block 106, a metal is electroplated onto the wafer substrate in the plating cell. Electrical power, which may be provided by controlling current and/or potential, may be applied to the wafer substrate to deposit the metal.

At block 108, the oxidizing strength of the plating solution is increased. The oxidizing strength of the plating solution may be increased at a location outside the plating cell. Increasing the oxidizing strength of the plating solution compensates for depletion of molecular oxygen at block 102 when the oxygen concentration in the plating solution is reduced. In some implementations, increasing the oxidizing strength of the plating solution may be performed in a reservoir or at various locations in a plating system. A reservoir is also referred to herein as an oxidation station. The amount that the oxidizing strength of the plating solution is increased may depend on the plating solution flow rates, the plating currents used to plate metal onto the wafer substrate, and the plating solution volumes. Increasing the oxidizing strength of the plating solution may be performed actively or passively. Examples of oxidizing agents that may be used to increase the oxidizing strength include oxygen, purified oxygen, ozone, hydrogen peroxide, nitrous oxide, and various other conventional oxidizing agents which do not interfere with electroplating. The chosen oxidizing agent may promote the formation or maintain the formation of a plating additive in its active operating state. The chosen oxidizing agent may be reasonably soluble in the plating solution. Alternative examples of oxidizing agents include a salt or other compound containing an oxidizing anions or cations, such as ferric ions (Fe(III)) or cerium ions (Ce(IV)), for example.

In some implementations, increasing the oxidizing strength of the plating solution is preformed passively. In passive processes, the plating solution may be exposed to air. Oxygen gas in air may be permitted to diffuse into the plating solution and thereby reoxygenate the solution. For example, a reservoir may maintain an amount of the plating solution in contact with air under, e.g., ambient conditions. Oxygen and nitrogen from air will gradually diffuse into the plating solution while it resides in the reservoir, passively increasing the oxidizing strength of the solution. In some implementations, oxygen is added to the plating solution by exposing the plating solution to oxygen, purified oxygen, or ozone if the re-introduction of nitrogen into the plating solution is not desired. In some implementations, oxygen is added to the plating solution as by exposing the plating solution to nitrous oxide. For example, the oxygen concentration of the environment in the reservoir may be about 2 ppm to 5 ppm. The concentration of oxygen in the plating solution may be about 1 ppm or greater or about 2 ppm to 5 ppm after increasing the oxidizing strength the plating solution.

In some other implementations, increasing the oxidizing strength of the plating solution is performed actively. An active process implies increasing the oxidizing strength of the plating solution occurs at a faster rate than would be experienced by a passive process, i.e., contacting an amount of the plating solution with air or other ambient condition. Active processes may include a mechanism to promote an increase in the oxidizing strength of the plating solution.

Actively increasing the oxidizing strength of the plating solution may be performed in a reservoir or at another position downstream from the point where the oxygen concentration in the plating solution is reduced. Oxidizing agents (including air) may be introduced into the plating solution by any appropriate mechanism. For example, if the oxidizing agent is a gas, it may be introduced by bubbling the gas into the plating solution via an appropriate bubbling mechanism present in the reservoir or at another location within the plating system. In another example, increasing the oxidizing strength of the plating solution may be accomplished by increasing the air or gas contact area of the plating solution by passing the plating solution over wicking materials, ribs, or other high surface area structures. If the oxidizing agent is a liquid, it may be introduced by adding the liquid to the plating solution.

An experiment was performed to characterize the impact of degassing on the fill performance of the plating solution, the stability of additives to the plating solution, and the polarization consistency of the plating solution during extended periods electroplating (i.e., 0 hours to 320 hours) with the same plating solution. The experiments showed that by reducing the concentration of oxygen in a plating solution to 2 ppm, the stability of accelerator, suppressor, and leveler additives to the plating solution were significantly improved, that the fill performance was improved slightly, that the degree of polarization of the plating solution was more consistent and remained more negative than 500 mV at 10 $mA/cm^2$, and that byproduct generation was decreased compared to a plating solution with an oxygen concentration from the ambient environment.

Another experiment was performed to characterize the fill performance, the degree of polarization, and the accelerator concentration remaining in a plating solution after 30 hours of plating with the plating solution. This experiment was performed with several plating solutions having different oxygen concentrations. Accelerator stability improved continuously as the oxygen concentration was decreased to very low levels (i.e., oxygen concentration from the ambient environment to an oxygen concentration of 10 parts per billion (ppb)). At the same time, the polarization strength of the plating solution began to decrease as the oxygen concentration dropped below 1 ppm. The fill performance was degraded somewhat for the plating solution with the oxygen concentration from the ambient environment. This was because the accelerator concentration (e.g., the SPS concentration) was too low for optimum fill performance. Fill performance was seen to improve for the 1 ppm and 0.5 ppm oxygen concentration plating solutions, because the accelerator stability and thus its concentration in the plating solution remained closer to the starting level. At even lower oxygen concentrations (i.e., less than 0.5 ppm), the fill performance was severely degraded even though accelerator stability was good. This happened because the MPS byproduct was stabilized in the bath at too high a concentration, resulting in a loss of polarization because MPS is a stronger catalyst for copper plating than SPS.

Apparatus

Generally, the relevant apparatus will include a plating cell which employs a plating solution during electroplating and a plating solution circulation loop which holds and recycles the plating solution when it is not present in the plating cell. The plating solution circulation loop may also include other elements such as filters, reservoirs, pumps, and/or degassers.

Figure 2A:
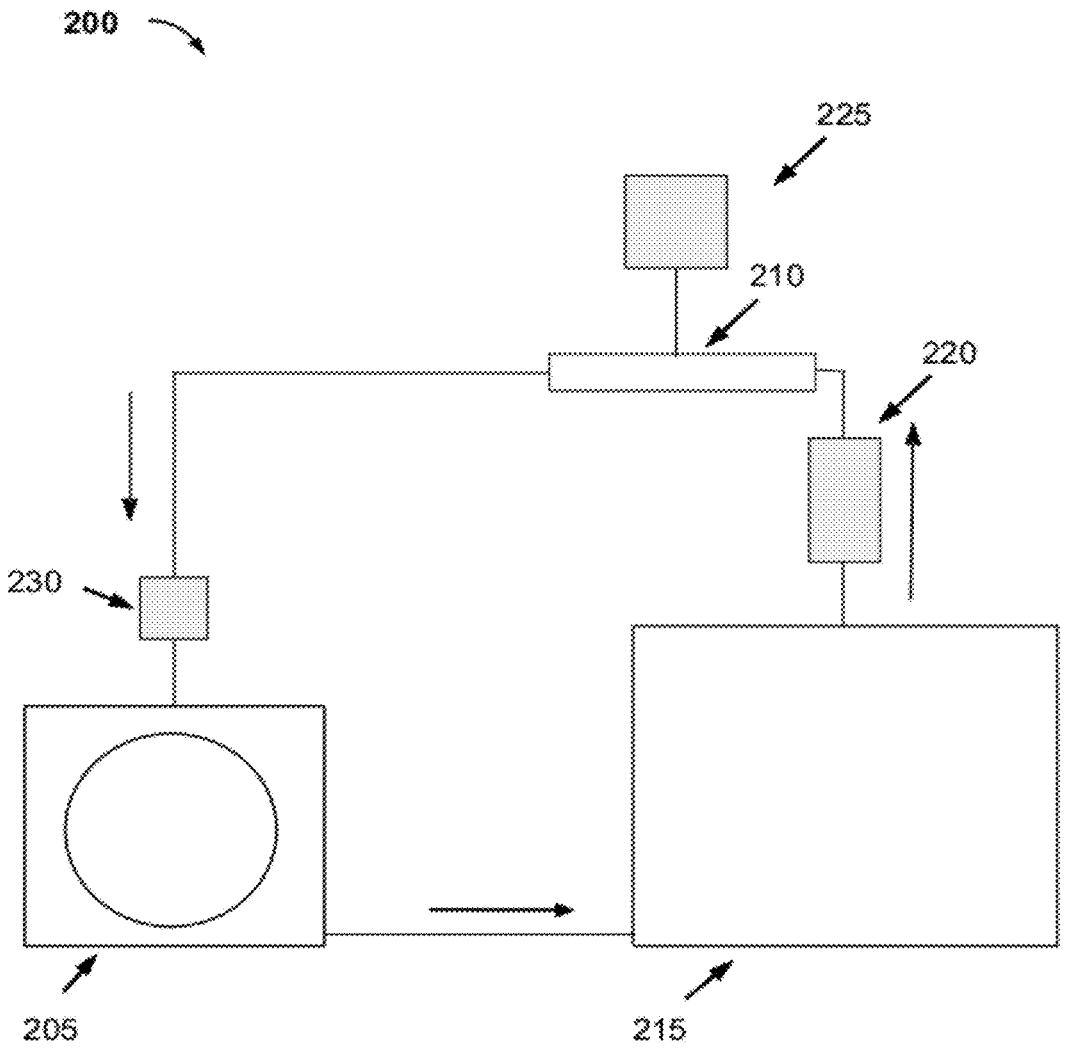
FIG. 2A shows an example of a schematic illustration of an apparatus configured to perform the methods disclosed herein.

FIG. 2A shows an example of a schematic illustration of an apparatus designed or configured to perform the methods disclosed herein. The apparatus 200 includes: a plating cell 205 for plating a metal onto a wafer substrate using a plating solution; a degassing device 210 configured to remove gasses from the plating solution prior to delivery of the plating solution to the plating cell; and, a reservoir 215 positioned between the plating cell 205 and the degassing device 210, the reservoir being configured to promote increasing the oxidizing strength of the plating solution. The arrows associated with the apparatus 200 indicate the flow of the plating solution in the apparatus. That is, when the apparatus 200 is in operation, the plating solution may flow from the reservoir 215, into the degassing device 210, into the plating cell 205, and back into the reservoir 215. The plating solution may flow from the plating cell 205 to the reservoir 215 by the force of gravity, for example. Pumps, such as pump 220, also may pump the plating solution through the components of the apparatus 200. The plating solution passes through a filter 230 before entering the plating cell 205. The apparatus 200 may further include various valves, vacuum pumps, further filters, and other hardware (not shown).

Before the plating solution enters the plating cell 205 from the plating solution reservoir 215, the plating solution passes through the degassing device 210. The degassing device 210 may be coupled to a vacuum pump 225 to degas the plating solution. A degassing device may also be referred to as a degasser or a contactor. The degassing device 210 removes one or more dissolved gasses (e.g., both molecular oxygen and molecular nitrogen) from the plating solution. In some implementations, the degassing device is a membrane contact degasser. Examples of commercially available degassing devices include the Liquid-Cel™ from Membrana (Charlotte, N.C.) and the pHasor™ from Entegris (Chaska, Minn.). The degassing device may remove gasses dissolved in the plating solution to an extent determined by, for example, the plating solution flow rate, the exposed area and nature of semi-permeable membrane across which a vacuum is applied to the degassing device, and the strength of the applied vacuum. Typical membranes used in degassers allow the flow of molecular gasses but do not permit the flow of larger molecules or solutions which cannot wet the membrane.

The reservoir 215 may provide active or passive introduction of an oxidizing agent to the plating solution. Passive introduction may include, e.g., exposure of the plating solution to air. Active introduction may include use of bubblers, high surface area air contact structures, etc.

Figure 2B:
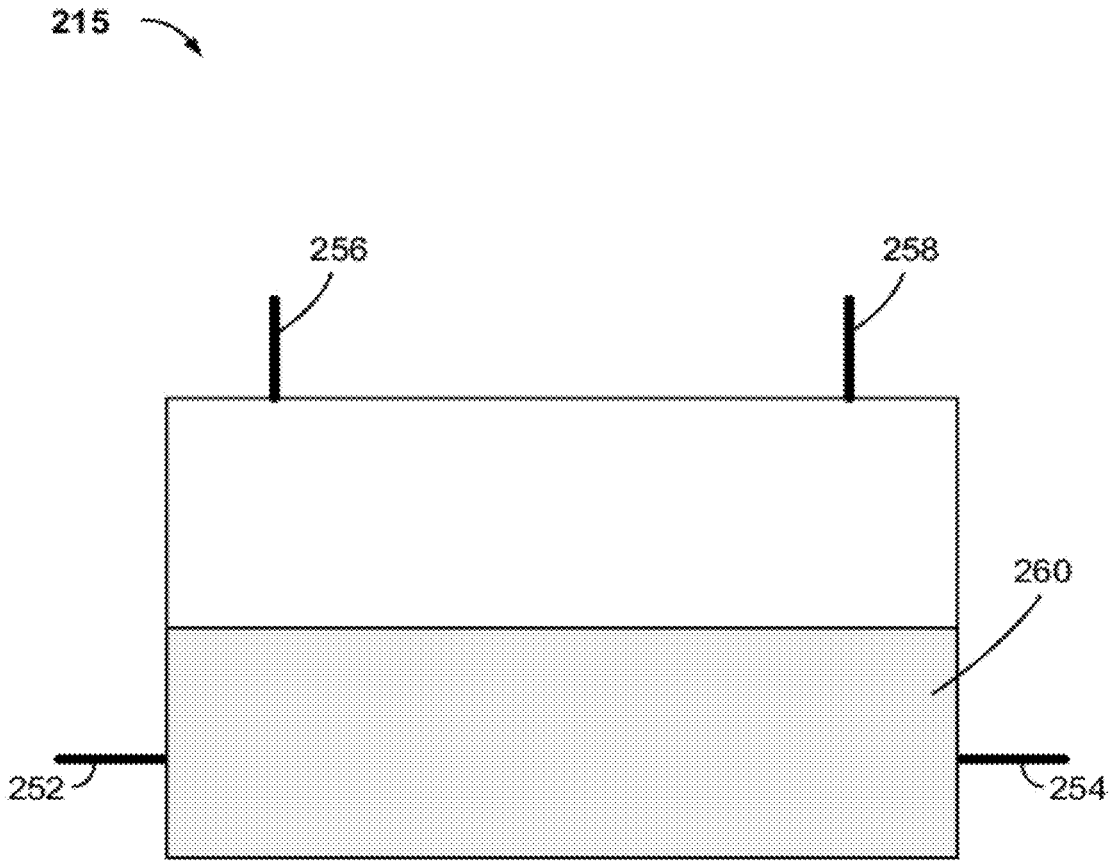
FIG. 2B shows an example of a schematic illustration of a reservoir.

FIG. 2B shows an example of a schematic illustration of a reservoir. The reservoir 215 contains a plating solution 260. The reservoir 215 includes a plating solution inlet port 252, a plating solution exit port 254, a gas inlet port 256, and a gas exit port 258. The reservoir may include membranes, fibers, ribs, coils, or other high surface area structures (not shown). The plating solution 260 may flow over the high surface area structures to expose a large surface area of the plating solution to a gas. The structures in the reservoir may be made from a plastic (e.g., polypropylene) or a metal, for example. While the plating solution is passing over the structures it is also brought in contact with a gas flow from gas inlet port 256 (e.g., an oxygen flow or other oxygen-containing gas flow) to facilitate reoxygenation of the plating solution. The design of the reservoir may employ features commonly found in evaporative coolers, for example.

Thus, the plating solution in the plating apparatus 200 may have a low concentration of gas (e.g., when it is degassed) in the plating cell 205. At locations outside of the plating cell, however, the plating solution may be sufficiently oxidizing to push the equilibrium state of an additive to the plating solution toward a preferred state (e.g., disulfide as opposed to mercaptan).

In some implementations, the oxygen concentration may be maintained at particular levels at different positions or stations within the apparatus 200 when the apparatus 200 is in operation. For example, the apparatus may be designed and operated in a manner whereby the oxygen concentration in the plating solution is within particular ranges at various locations or stages within the apparatus. In one embodiment, the concentration of molecular oxygen in the plating cell is maintained at a level of about 0.1 ppm to 1 ppm, which the concentration of molecular oxygen at locations downstream from the plating cell (e.g., in a reservoir) is maintained at a level of about 2 ppm to 5 ppm.

Methods of controlling the concentration of oxygen in the plating solution include: (1) positioning degassing devices or reservoirs at particular locations in the apparatus, (2) providing inlet or dosing ports for the introduction of oxygen or oxidizing agents at one or more locations in the apparatus, and/or (3) controlling the hydrodynamics of the plating solution flow through the loop. Regarding the last possibility, pumps may be controlled, for example, in a manner that affects a desired level of degassing in a degassing device.

In some implementations, the concentration of oxygen (or other oxidizing agent or gas) is monitored at one or more (or two or more) locations in the apparatus 200. In one example, the apparatus may include oxygen monitors in the reservoir, in the plating cell, and/or in another location in the plating solution circulation loop of the apparatus. For example, on-line oxygen monitoring may be achieved using a commercially available oxygen probe such one made by In-Situ, Inc. (Ft. Collins, Colo.). In another example, a hand-held oxygen meter may be employed, such as a commercially available meter made by YSI, Inc. (Yellow Springs, Ohio).

Another aspect of the disclosed implementations is an apparatus configured with a controller to accomplish the methods described herein. A suitable apparatus includes hardware for accomplishing the process operations and a system controller having instructions for controlling process operations in accordance with the disclosed implementations. The controller may act on various inputs including user inputs or sensed inputs from, e.g., oxygen monitors at one or more locations in the apparatus. In response to pertinent inputs, the controller executes control instructions for causing the apparatus to operate in a particular manner. For example, the controller may adjust the level of pumping, active oxygenation, or other controllable feature of the apparatus to adjust or maintain the concentration of oxygen at a particular defined numerical range in the reservoir and at a different defined numerical range within the electroplating cell. In this regard, the controller may be configured, for example, to operate a pump of the apparatus at a level that maintains the oxygen concentration at about 2 ppm to 5 ppm in the reservoir (or at some other point downstream from the electroplating cell in the recirculation loop). The system controller will typically include one or more memory devices and one or more processors configured to execute the instructions so that the apparatus will perform a method in accordance with the disclosed implementations. Machine-readable media containing instructions for controlling process operations in accordance with the disclosed implementations may be coupled to the system controller.

Figure 3:
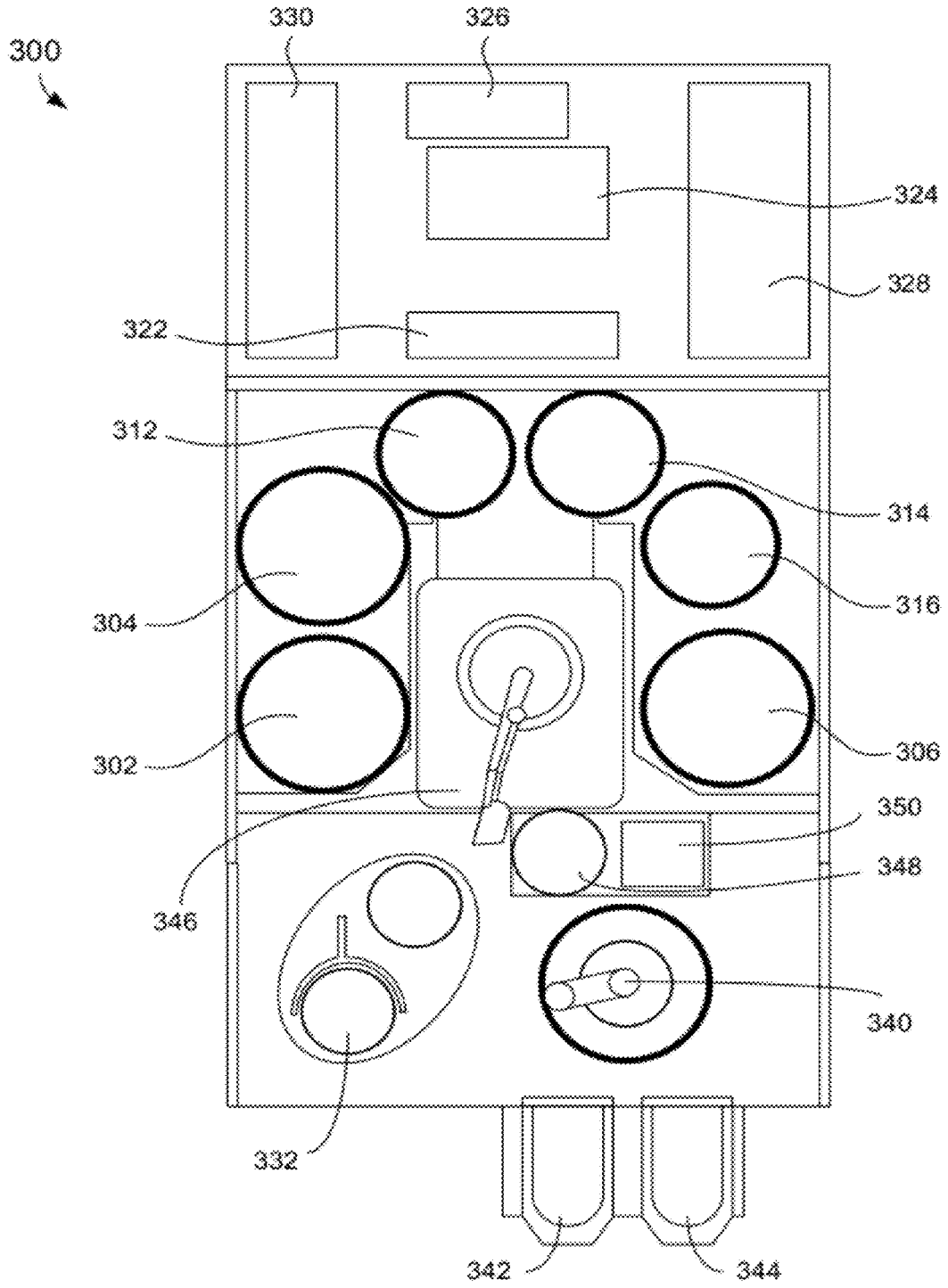
FIG. 3 shows an example of a schematic illustration of an electrofill system.

FIG. 3 shows an example of a schematic illustration of an electrofill system 300. The electrofill system 300 includes three separate electrofill modules 302, 304, and 306. The electrofill system 300 also includes three separate post electrofill modules (PEMs) 312, 314, and 316 configured for various process operations. The modules 312, 314, and 316 may be post electrofill modules (PEMs) each configured to perform a function, such as edge bevel removal, backside etching, and acid cleaning of wafers after they have been processed by one of the electrofill modules 302, 304, and 306.

The electrofill system 300 includes a central electrofill chamber 324. The central electrofill chamber 324 is a chamber that holds the chemical solution used as the plating solution in the electrofill modules. The electrofill system 300 also includes a dosing system 326 that may store and deliver chemical additives for the plating solution. A chemical dilution module 322 may store and mix chemicals to be used as an etchant, for example, in a PEM. A filtration and pumping unit 328 may filter the plating solution for the central electrofill chamber 324 and pump it to the electrofill modules. The system also includes a degassing device or degassing devices and a reservoir or reservoirs (not shown), as described above. The plating solution may pass through the degassing device before in is pumped to the electroplating modules. The plating solution may pass through the reservoir after it flows out of the electroplating modules.

A system controller 330 provides the electronic and interface controls required to operate the electrofill system 300. The system controller 330 generally includes one or more memory devices and one or more processors configured to execute instructions so that the apparatus can perform a method in accordance with the implementations described herein. Machine-readable media containing instructions for controlling process operations in accordance with the implementations described herein may be coupled to the system controller. The system controller 330 may also include a power supply for the electrofill system 300.

An example of an electroplating module and associated components is shown in U.S. patent application Ser. No. 12/786,329, entitled "PULSE SEQUENCE FOR PLATING ON THIN SEED LAYERS," filed May 24, 2010, which is herein incorporated by reference.

In operation, a hand-off tool 340 may select a wafer from a wafer cassette such as the cassette 342 or the cassette 344. The cassettes 342 or 344 may be front opening unified pods (FOUPs). A FOUP is an enclosure designed to hold wafers securely and safely in a controlled environment and to allow the wafers to be removed for processing or measurement by tools equipped with appropriate load ports and robotic handling systems. The hand-off tool 340 may hold the wafer using a vacuum attachment or some other attaching mechanism.

The hand-off tool 340 may interface with an annealing station 332, the cassettes 342 or 344, a transfer station 350, or an aligner 348. From the transfer station 350, a hand-off tool 346 may gain access to the wafer. The transfer station 350 may be a slot or a position from and to which hand-off tools 340 and 346 may pass wafers without going through the aligner 348. In some implementations, however, to ensure that a wafer is properly aligned on the hand-off tool 346 for precision delivery to an electrofill module, the hand-off tool 346 may align the wafer with an aligner 348. The hand-off tool 346 may also deliver a wafer to one of the electrofill modules 302, 304, or 306 or to one of the three separate modules 312, 314, and 316 configured for various process operations.

For example, the hand-off tool 346 may deliver the wafer substrate to the electrofill module 302 where a metal (e.g., copper) is plated onto the wafer substrate in accordance with implementations described herein. After the electroplating operation completes, the hand-off tool 346 may remove the wafer substrate from the electrofill module 302 and transport it to one of the PEMs, such as PEM 312. The PEM may clean, rinse, and/or dry the wafer substrate. Thereafter, the hand-off tool 346 may move the wafer substrate to another one of the PEMs, such as PEM 314. There, unwanted metal (e.g., copper) from some locations on the wafer substrate (e.g., the edge bevel region and the backside) may etched away by an etchant solution provided by chemical dilution module 322. The module 314 may also clean, rinse, and/or dry the wafer substrate.

After processing in the electrofill modules and/or the PEMs is complete, the hand-off tool 346 may retrieve the wafer from a module and return it to the cassette 342 or the cassette 344. A post electrofill anneal may be completed in the electrofill system 300 or in another tool. In one implementation, the post electrofill anneal is completed in one of the anneal stations 332. In some other implementations, dedicated annealing systems such as a furnace may be used. Then the cassettes can be provided to other systems such as a chemical mechanical polishing system for further processing.

Suitable semiconductor processing tools include the Sabre System and the Sabre System 3D Lite manufactured by Novellus Systems of San Jose, Calif., the Slim cell system manufactured by Applied Materials of Santa Clara, Calif., or the Raider tool manufactured by Semitool of Kalispell, Mont.

Further Implementations

The apparatus/methods described hereinabove may be used in conjunction with lithographic patterning tools or processes, for example, for the fabrication or manufacture of semiconductor devices, displays, LEDs, photovoltaic panels and the like. Generally, though not necessarily, such tools/processes will be used or conducted together in a common fabrication facility. Lithographic patterning of a film generally comprises some or all of the following steps, each step enabled with a number of possible tools: (1) application of photoresist on a work piece, i.e., a substrate, using a spin-on or spray-on tool; (2) curing of photoresist using a hot plate or furnace or UV curing tool; (3) exposing the photoresist to visible, UV, or x-ray light with a tool such as a wafer stepper; (4) developing the resist so as to selectively remove resist and thereby pattern it using a tool such as a wet bench; (5) transferring the resist pattern into an underlying film or work piece by using a dry or plasma-assisted etching tool; and (6) removing the resist using a tool such as an RF or microwave plasma resist stripper.

It should also be noted that there are many alternative ways of implementing the disclosed methods and apparatuses. It is therefore intended that the following appended claims be interpreted as including all such alterations, modifications, permutations, and substitute equivalents as fall within the true spirit and scope of the disclosed implementations.

What is claimed is:

1. A method of electroplating a substrate using a controller, the controller having a processor and a memory, the memory containing machine-readable instructions executable by the processor for controlling the level of active oxygenation of a plating solution, the method comprising:

(a) reducing an oxygen concentration of a plating solution, wherein the plating solution includes about 100 parts per million or less of an accelerator;

(b) after operation (a), contacting, in a plating cell, a wafer substrate with the plating solution, wherein the oxygen concentration of the plating solution in the plating cell is about 1 part per million or less;

(c) electroplating a metal with the plating solution onto the wafer substrate in the plating cell, wherein the electroplating causes a net conversion of the accelerator to a less-oxidized accelerator species within the plating cell; and (d) after operation (c), using the controller to increase an oxidizing strength of the plating solution outside the plating cell by controlling the level of active oxygenation of the plating solution, wherein the increased oxidizing strength causes a net re-conversion of the less-oxidized accelerator species back to the accelerator outside the plating cell.

2. The method of claim 1, wherein the accelerator is bis (3-sulfopropyl) disulfide (SPS), and the less-oxidized accelerator species is mercaptopropanesulfonic acid (MPS).

3. The method of claim 1, further comprising:

supplying the plating solution to the plating cell from a plating reservoir, wherein the oxygen concentration of the plating solution in the plating reservoir is 2-5 parts per million, and wherein reducing the oxygen concentration of the plating solution is performed as the plating solution is supplied from the plating reservoir.

4. The method of claim 1, wherein operation (d) includes exposing the plating solution to a gas containing an oxidizing agent, and wherein the gas is selected from the group consisting of air, oxygen, ozone, and nitrous oxide.

5. The method of claim 1, wherein operation (d) includes exposing the plating solution to a gas containing an oxidizing agent by bubbling the gas through the plating solution, and wherein the gas is selected from the group consisting of air, oxygen, ozone, and nitrous oxide.

6. The method of claim 1, wherein operation (d) includes exposing the plating solution to a gas containing an oxidizing agent while increasing the gas contact area of the plating solution, and wherein the gas is selected from the group consisting of air, oxygen, ozone, and nitrous oxide.

7. The method of claim 1, wherein operation (d) includes mixing a liquid containing an oxidizing agent into the plating solution.

8. The method of claim 7, wherein the liquid includes hydrogen peroxide.

9. The method of claim 1, wherein operation (a) is performed by sparging the plating solution using helium or nitrogen.

10. The method of claim 1, wherein operation (a) improves the stability of the plating solution.

11. The method of claim 1, wherein operation (d) improves the fill characteristics of the plating solution for filling a feature on the wafer substrate.

12. The method of claim 1, further comprising:

applying photoresist to the wafer substrate;

exposing the photoresist to light;

patterning the photoresist and transferring the pattern to the wafer substrate; and selectively removing the photoresist from the wafer substrate.

13. The method of claim 1, further comprising:

monitoring an oxygen concentration of the plating solution;

wherein, in operation (d), the controller adjusts the level of active oxygenation of the plating solution in response to said monitored oxygen concentration.

14. The method of claim 1, wherein, in operation (d), the controller controls the level of active oxygenation to increase an oxygen concentration of the plating solution outside the plating cell to 2-5 parts per million.

15. The method of claim 1, wherein, in operation (d), the controller controls the level of active oxygenation of the plating solution by introducing an oxidizing agent into the plating solution.

16. The method of claim 1, further comprising: repeating operations (a) and (d), wherein the plating solution flows through the plating cell while operation (c) is performed.

* * * * *